US009540221B2

(12) United States Patent
Wang et al.

(10) Patent No.: US 9,540,221 B2
(45) Date of Patent: Jan. 10, 2017

(54) SELF-ADJUSTING SUPPORTING HEAD

(71) Applicant: CRRC QINGDAO SIFANG ROLLING STOCK RESEARCH INSTITUTE CO., LTD, Qingdao, Shandong (CN)

(72) Inventors: Minghai Wang, Shandong (CN); Hui Ding, Shandong (CN); Yong Wang, Shandong (CN); Xiaolei Zhao, Shandong (CN)

(73) Assignee: CRRC QINGDAO SIFANG ROLLING STOCK RESEARCH INSTITUTE CO., LTD., Shandong (CN)

( * ) Notice: Subject to any disclaimer, the term of this patent is extended or adjusted under 35 U.S.C. 154(b) by 0 days.

(21) Appl. No.: 15/177,306

(22) Filed: Jun. 8, 2016

(65) Prior Publication Data

US 2016/0280521 A1 Sep. 29, 2016

Related U.S. Application Data

(63) Continuation of application No. PCT/CN2014/088891, filed on Oct. 20, 2014.

(30) Foreign Application Priority Data

Aug. 18, 2014 (CN) ..... 2014 1 0405841

(51) Int. Cl.
*B66F 7/00* (2006.01)
*B66F 7/28* (2006.01)
*B61F 99/00* (2006.01)

(52) U.S. Cl.
CPC ..... *B66F 7/28* (2013.01); *B61F 99/00* (2013.01); *B66F 2700/12* (2013.01)

(58) Field of Classification Search
CPC ..... B66F 1/00; B66F 7/00; B66F 7/16; B66F 9/02; B66F 9/127
See application file for complete search history.

(56) References Cited

U.S. PATENT DOCUMENTS 8,282,076 B2 * 10/2012 Takahashi ..... B66F 19/005 254/13
8,333,365 B2 * 12/2012 Dai ..... B66F 3/25 188/67

(Continued)

FOREIGN PATENT DOCUMENTS

CN 201566650 U 9/2010
CN 201574064 U 9/2010

(Continued)

OTHER PUBLICATIONS

International Search Report of corresponding International PCT Application No. PCT/CN2014/088891, dated Mar. 4, 2015.

(Continued)

*Primary Examiner* — Lee D Wilson
(74) *Attorney, Agent, or Firm* — J.C. Patents

(57) ABSTRACT

A self-adjusting supporting head comprises a vehicle body lifting column (10) and a load-bearing detection device arranged on the vehicle body lifting column (10). The load-bearing detection device comprises a spring supporting plate (5), a spring (6), a limiting switch tip (8), a load limiting switch (9) and a floating load-bearing adjusting device. The floating load-bearing adjusting device comprises a floating load-bearing block (1), a floating load-bearing block mounting base (2) and a floating connector. The floating load-bearing block is in spherical fit with the floating load-bearing block mounting base.

10 Claims, 5 Drawing Sheets

(56) References Cited

U.S. PATENT DOCUMENTS

| | | | | |
|---|---|---|---|---|
| 8,684,141 | B2 * | 4/2014 | Herrmann | B66F 7/18<br>187/215 |
| 2016/0122164 | A1 * | 5/2016 | Martinez Martinez | B66F 3/25<br>254/93 R |

FOREIGN PATENT DOCUMENTS

| | | | |
|---|---|---|---|
| CN | 102060027 | A | 5/2011 |
| CN | 102718172 | A | 10/2012 |
| CN | 102060027 | B | 11/2012 |

OTHER PUBLICATIONS

Chinese Notice of the First Office Action of corresponding China patent Application No. 201410405841.0, dated Nov. 4, 2015.
Chinese Notification to Grant Patent Right of corresponding China patent Application No. 201410405841.0, dated Jan. 22, 2016.

* cited by examiner

SELF-ADJUSTING SUPPORTING HEAD

CROSS-REFERENCE TO RELATED APPLICATIONS

This application is a continuation of International application No. PCT/CN2014/088891 filed on Oct. 20, 2014, entitled SELF-ADJUSTING SUPPORTING HEAD, which claims the priority benefit of Chinese patent application No. 201410405841.0, filed on Aug. 18, 2014. The contents of the above-mentioned patent applications are incorporated by reference herein in their entirety and made a part of this specification.

FIELD OF THE INVENTION

The present invention relates to a kind of maintenance operation equipment used in non-disintegrated rack car of motor train unit and urban rail vehicles, in particular, to a kind of self-adjusting supporting head of vehicle body lifting unit of pit-type lifting jack used in train vehicle body.

BACKGROUND OF THE INVENTION

When a pit-type lifting jack is used in maintenance operation of non-disintegrated rack car of motor train unit and urban rail vehicles, it is necessary to lift the vehicle to a certain height with the supporting wheel of bogie lifting unit, and then support four lifting points of track car using four supporting heads of the pit-type lifting jack, so as to replace the vehicle bogie and carry out the maintenance and replacement operations for the electrical facilities at the lower part and the top of vehicle.

With the extensive operation of motor train units in China, there are more and more cities that have started the urban rail transportation. In order to ensure the operation safety and reliability of above vehicles, it is necessary to carry out regular repair and maintenance on the wheel sets of the vehicle bogie and underbody. The pit-type lifting jack plays an important role in the vehicle repair and maintenance process. Currently, there are two kinds of structure of supporting heads of pit-type lifting jack; one is the supporting head with weighing function, and the other is the basic type supporting head. The basic type supporting head has a simple structure, and it is inconvenient to adjust a variety of supporting heads simultaneously. At present, most supporting heads used are the traditional supporting heads with the weighing function, as shown in FIG. 1 and FIG. 2. Chinese patent (Publication No. CN102060027A) discloses a detection type supporting head of lifting system with weighing function. This kind of supporting head comprises a supporting head body and a load-bearing detection device arranged on the supporting head body. By adjusting the lifting positions of the mandril, the distance between the load-bearing plate and the baffle can be adjusted. It can achieve adjustment conveniently and display the weight of the whole vehicle, but when adjusting a variety of supporting heads, it is necessary to adjust them one by one repeatedly, with poor precision and heavy workload. During lifting maintenance operation, the size error of four steel plates welded on the side beam of vehicles can not be avoided, with a certain height difference between the four steel plates, thus, they can not be on the same plane. For the above supporting heads with weighing functions and basic type supporting heads, it is inconvenient to adjust a variety of supporting heads simultaneously, and when the load-bearing surface of the existing supporting head and the lifting column are an integral structure, the upper surface of supporting head can not form a state of line contact or point contact with four steel plates on the side beam completely when lifting, which easily causes damage to the vehicle.

SUMMARY OF THE INVENTION

The object of the invention is to provide a self-adjusting supporting head, and through the spherical fit structure between the floating load-bearing block and floating load-bearing block mounting base, to achieve the swing of the upper surface of floating load-bearing block with the state of multiple steel plates at any direction, and full contact between the upper surface of floating load-bearing block with the steel plates.

The invention adopts the following technical solutions: A self-adjusting supporting head comprises a vehicle body lifting column and a load-bearing detection device arranged on the vehicle body lifting column; the load-bearing detection device comprises a spring supporting plate, a spring, a limiting switch tip, a load limiting switch and a floating load-bearing adjusting device. The floating load-bearing adjusting device is mounted at the top of the vehicle body lifting column and the spring supporting plate is arranged below the floating load-bearing adjusting device, the spring is mounted on the periphery of the spring supporting plate, the upper end of the limiting switch tip is connected to the spring supporting plate and on the low end side is provided with a load limiting switch. the floating load-bearing adjusting device comprises a floating load-bearing block, a floating load-bearing mounting base and a floating connector; The floating load-bearing block is mounted on the upper end of the vehicle body lifting column; the floating load-bearing block mounting base is mounted below the floating load-bearing block. The floating load-bearing block is connected with the floating load-bearing block mounting base by a floating connector, and the floating load-bearing block is in spherical fit with the floating load-bearing block mounting base. A floating gap is formed by the floating connector between the floating load-bearing block and the floating load-bearing block mounting base. The floating load-bearing block can swing in random directions above the floating load-bearing block mounting base according to the specific state of a steel plate in contact with the floating load-bearing block.

The upper portion of the floating load-bearing block mounting base is provided with a cylindrical hole, and the cylindrical hole is of a two-stage step-type structure from top to bottom, including a first step and a second step, the first step is used to restrict the downward movement of the spring supporting plate, and the second step is used to restrict the downward movement of the spring.

The floating load-bearing adjusting device is further provided with a stop block, the stop block is fixed on the floating load-bearing block; the bottom part of the stop block is probed into the interior of the cylindrical hole, and a stop block movement gap is provided between the bottom part of the stop block and the cylindrical hole, which is used to restrict the floating load-bearing block to swing within the stop block movement gap only, to avoid a large-angle swing.

The spring supporting plate is of a T-shaped structure, including a spherical top end and a cylindrical supporting plate, the upper portion of the spherical top end is in point contact with the bottom end of the stop block, the lower end of the supporting plate is connected with the limiting switch tip, and the spring is arranged at the periphery of the cylindrical supporting plate.

The stop block is of an inverted T-shaped structure, and the top end of the inverted T-shaped structure is connected with the floating load-bearing block fixedly, the bottom end of the inverted T-shaped structure is in a point contact with the upper portion of the spherical top end.

The floating connector comprises a disc spring and a disc spring guide post, the disc spring guide post is fixed to inside of the floating load-bearing block mounting base, and the disc spring guide post is of an inverted T-shaped structure. The floating load-bearing block is provided with an inverted T-shaped groove that is fit with the inverted T-shaped structure, the disc spring is disposed between the inverted T-shaped structure and inverted T-shaped groove, when there is no load of the disc spring, a load-bearing block floating gap is formed between the lower surface of the floating load-bearing block and upper surface of the floating load-bearing block mounting base through the spring action of the disc spring, and the size of the floating gap between both is defined by the stop block.

There are two groups of the disc spring guide posts and the disc springs, which are uniformly distributed on both sides of the spring supporting plate, to ensure that the floating load-bearing block is uniformly stressed when the floating load-bearing block is in contact with the steel plate.

The end of the load limiting switch is of roller type, the load limiting switch is mounted on the side of the limiting switch tip, and under the non-working state, the load limiting switch and the limiting switch tip are in a state of separation.

Compared with prior art, this invention can achieve the following beneficial effects:

(1) The bottom part of the stop block is probed into the interior of the cylindrical hole, and a stop block movement gap is provided between the bottom part of the stop block and the cylindrical hole, which is used to restrict the floating load-bearing block to swing within the stop block movement gap only, instead of a large-angle swing, ensure that only a small angle adjustment is made between the floating load-bearing block and the floating load-bearing block mounting base, and guarantee that the adjustment between them is moderate;

(2) The floating load-bearing block is mounted on the floating load-bearing block mounting base through disc springs and disc spring guide posts. When there is no load of the disc spring, a load-bearing block floating gap is formed between the lower surface of the floating load-bearing block and upper surface of the floating load-bearing block mounting base through the spring action of the disc spring, making the floating load-bearing block connected with but not contacted with the floating load-bearing block mounting base, so that the floating load-bearing block can swing on the floating load-bearing block mounting base freely;

(3) The supporting head is provided with a floating load-bearing adjusting device, comprising a floating load-bearing block, a floating load-bearing mounting base and a floating connector. The floating load-bearing block is in spherical fit with the floating load-bearing block mounting base. The floating load-bearing block can swing in random directions above the floating load-bearing block mounting base according to the specific state of a steel plate in contact with the floating load-bearing block. When the height of a number of steel plates welded on the vehicle side beam is inconsistent, the floating load-bearing block can automatically align according to the steel plates through the spherical fit structure, and achieve full contact between the upper surface of the floating load-bearing block and the plurality of steel plates, ensure that the vehicle side beam is uniformly stressed, without damage to the vehicle.

Figure 1:
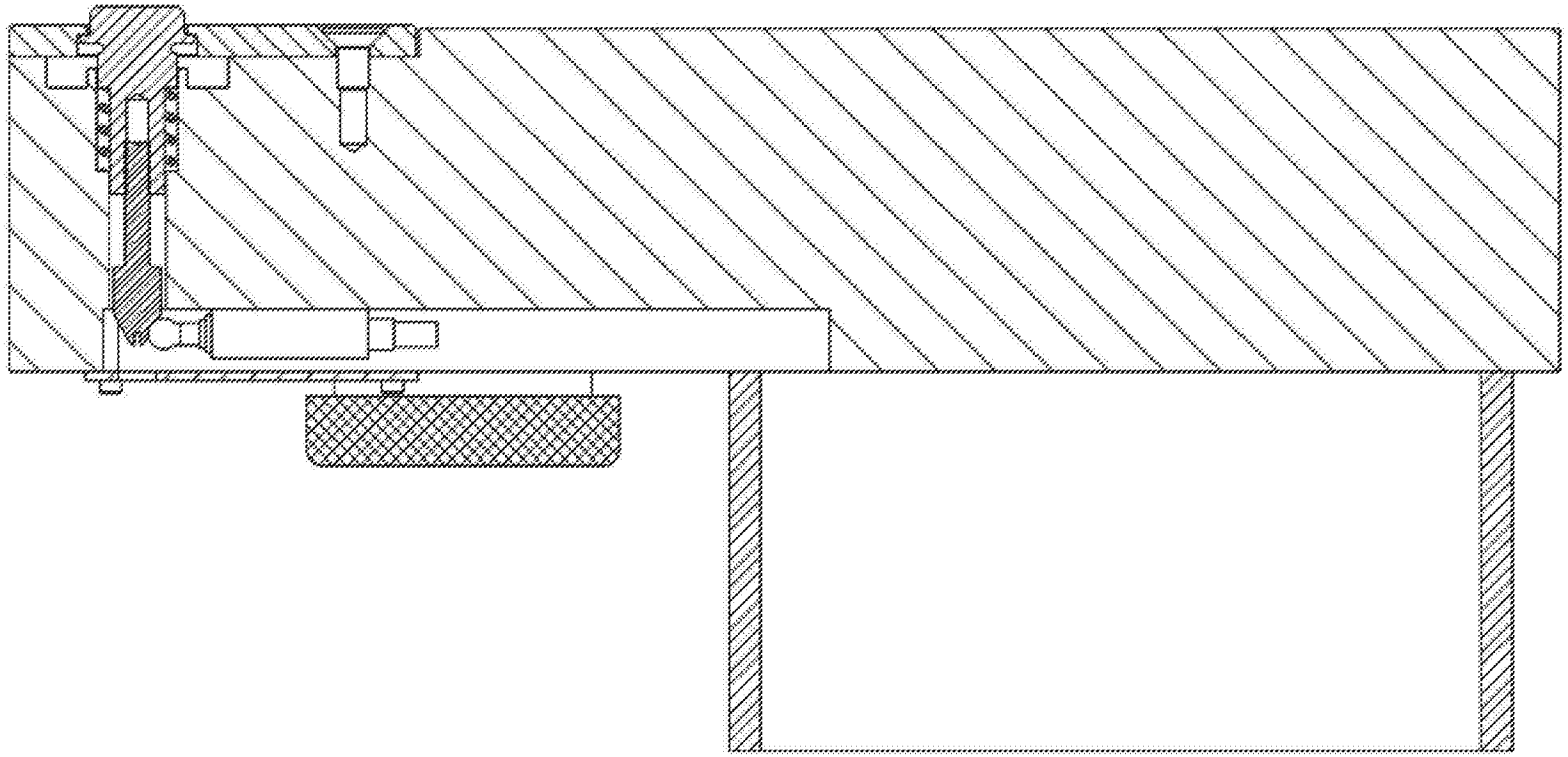
FIG. 1 (Prior Art)
FIG. 1 is a schematic diagram (I) of the prior supporting head.
Figure 2:
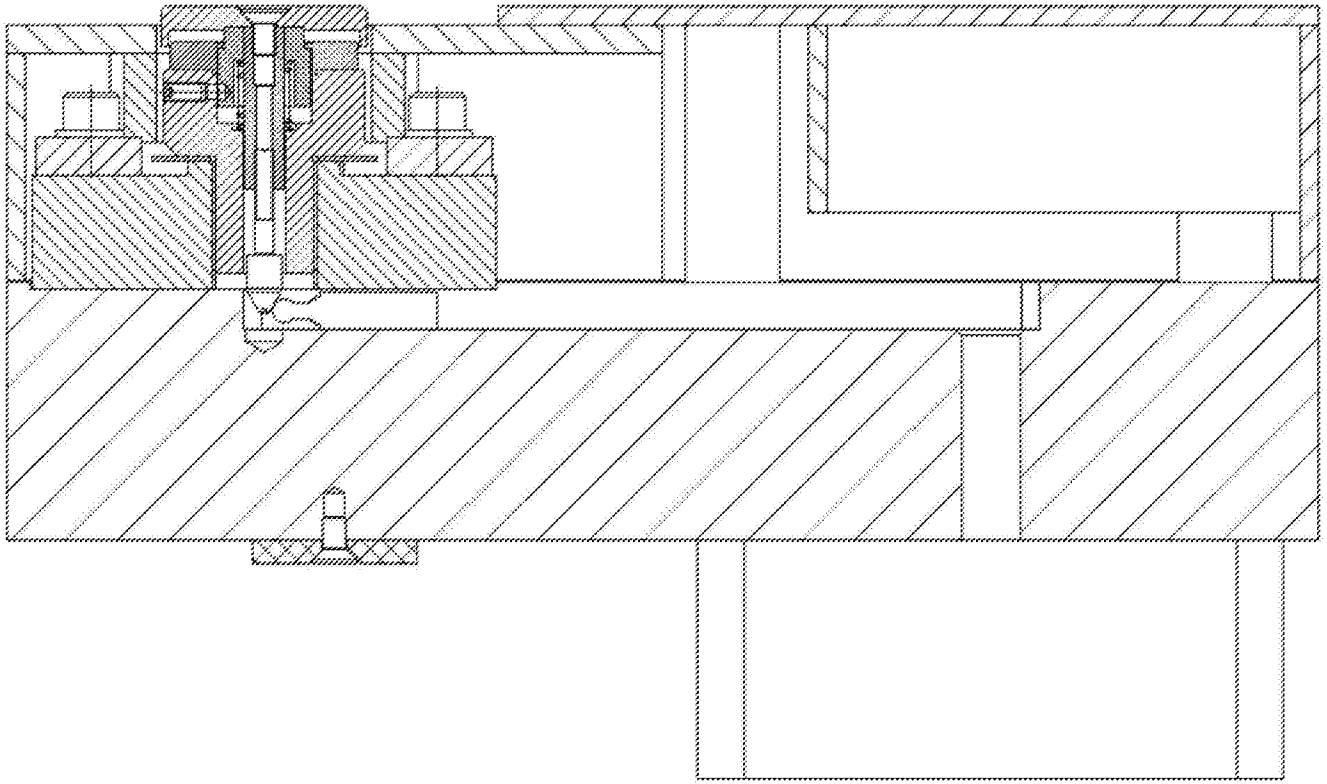
FIG. 2 (Prior Art)
FIG. 2 is schematic diagram (II) of the prior supporting head.
Figure 3:
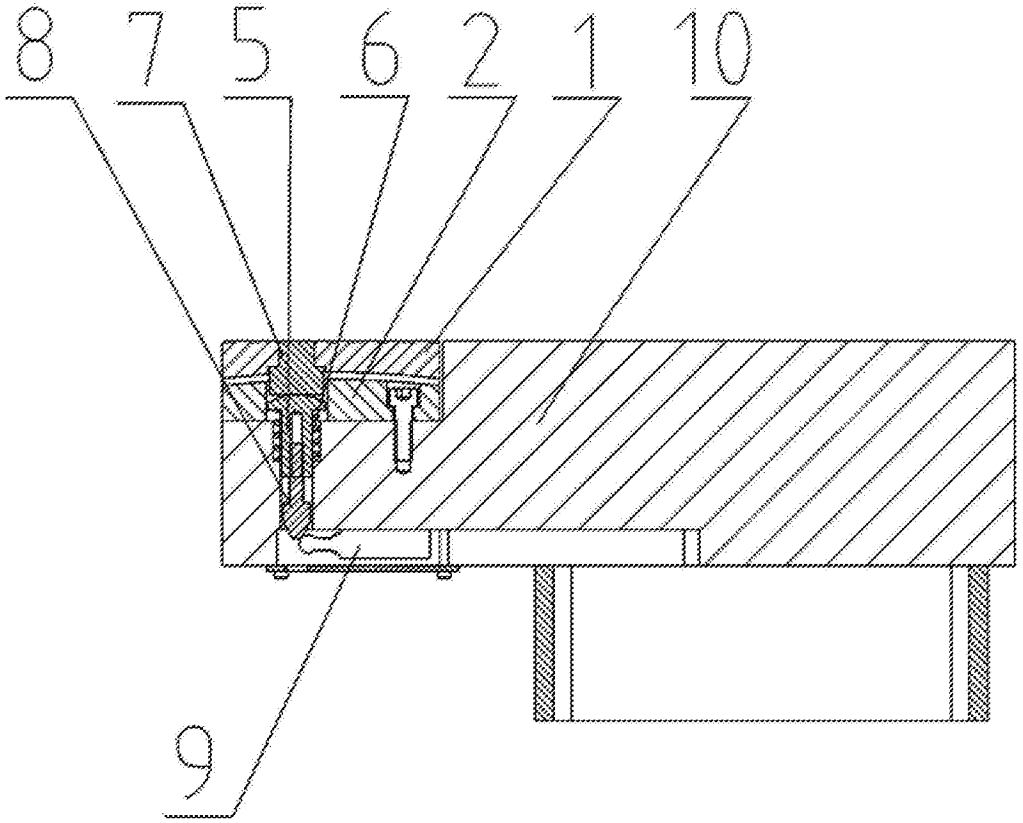
FIG. 3 is a schematic diagram of a supporting head in the present invention.
Figure 4:
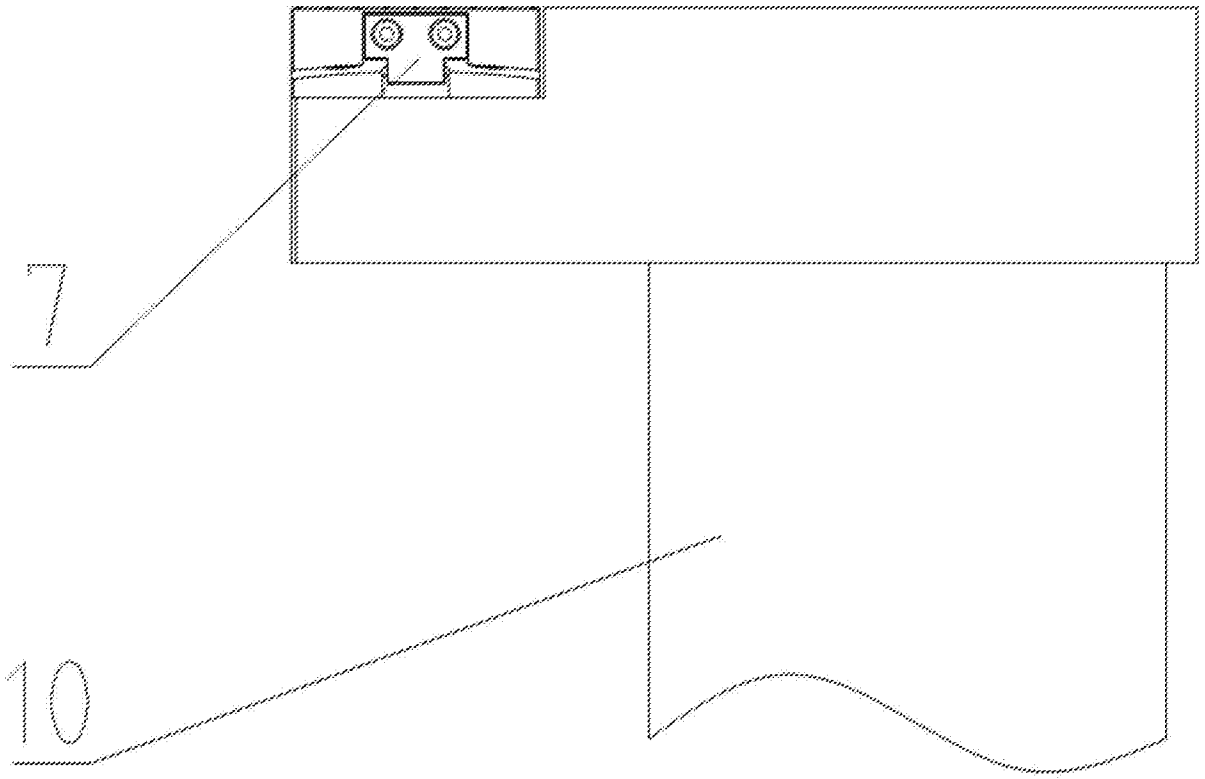
FIG. 4 is a schematic diagram of stop block structure in the present invention.
Figure 5:
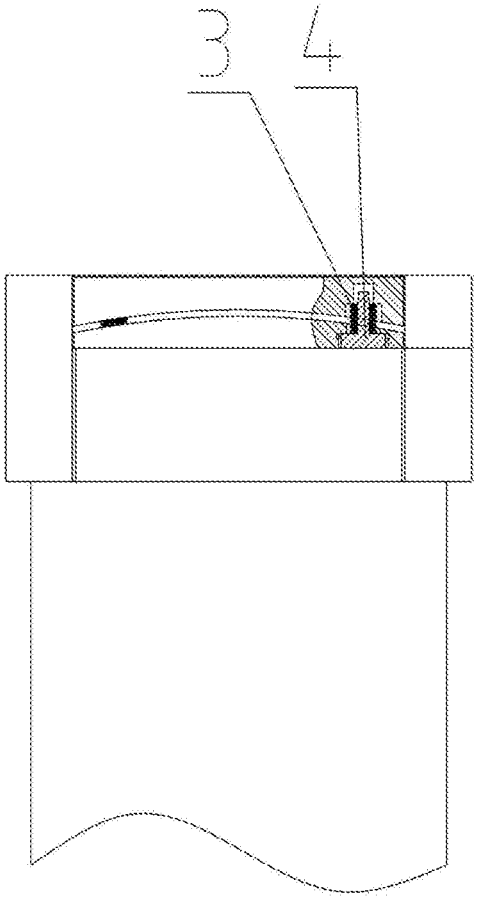
FIG. 5 is a schematic diagram of a disc spring and a disc spring guide post in the invention.

Of which, 1 floating load-bearing block; 2 floating load-bearing block mounting base; 3 disc spring; 4 disc spring guide post; 5 spring supporting plate; 6 spring; 7 stop block; 8 limiting switch tip; 9 load limiting switch; 10 vehicle body lifting column

DETAILED DESCRIPTION OF THE EMBODIMENTS

In order to clarify the object, technical solutions and advantages, the technical solutions are further described clearly and completely in combinations with the drawings in the embodiment. Apparently the embodiment described is only a part rather than whole of embodiments in the invention. All other embodiments made by technicians skilled in the art without creative work based on the embodiment herein shall fall within the scope of protection of the present invention.

Example 1

A self-adjusting supporting head comprises a vehicle body lifting column 10 and a load-bearing detection device arranged on the vehicle body lifting column 10; the load-bearing detection device comprises a spring supporting plate 5, a spring 6, a limiting switch tip 8, a load limiting switch 9 and a floating load-bearing adjusting device. The floating load-bearing adjusting device is mounted at the top of the vehicle body lifting column 10 and the spring supporting plate 5 is arranged below the floating load-bearing adjusting device, the spring 6 is mounted on the periphery of the spring supporting plate 5, the upper end of the limiting switch tip 8 is connected to the spring supporting plate 5 and on the low end side is provided with a load limiting switch 9.

The floating load-bearing adjusting device comprises a floating load-bearing block 1, a floating load-bearing block mounting base 2 and a floating connector. The floating load-bearing block 1 is mounted on the upper end of the vehicle body lifting column 10; the floating load-bearing block mounting base 2 is mounted below the floating load-bearing block 1. The floating load-bearing block is connected with the floating load-bearing block mounting base by a floating connector, and the floating load-bearing block 1 is in spherical fit with the floating load-bearing block mounting base 2. A floating gap is formed by the floating connector between the floating load-bearing block and the floating load-bearing block mounting base. The floating load-bearing block 1 can swing in random directions above the floating load-bearing block mounting base 2 according to the specific state of a steel plate in contact with the floating load-bearing block, and the load-bearing block floating gap between the both can be defined by the stop block 7.

The upper portion of the floating load-bearing block mounting base 2 is provided with a cylindrical hole, and the cylindrical hole is of a two-stage step-type structure from top to bottom, including a first step and a second step, the first step is used to restrict the downward movement of the spherical end of the spring supporting plate 5, and the second step is used to restrict the downward movement of the spring 6; the stop block 7 is fixed on the floating load-bearing block 1, the bottom part of the stop block 7 is probed into the interior of the cylindrical hole, and a stop block movement gap is provided between the bottom part of the stop block 7 and the cylindrical hole, which is used to restrict the floating load-bearing block 1 to swing within the stop block movement gap only, instead of swinging at a large angle;

The spring supporting plate 5 is of a T-shaped structure, including a spherical top end and a cylindrical supporting plate, the upper portion of the spherical top end is in point contact with the bottom end of the stop block 7, the lower end of the supporting plate is connected with the limiting switch tip 8, and the spring 6 is arranged at the periphery of the cylindrical supporting plate. Under the load, the spherical top end of the spring supporting plate 5 receives the pressure from the stop block 7, and successively presses the spring 6 and limiting switch tip 8 downward until the limiting switch tip 8 triggers the load limiting switch 9;

The disc spring guide post 4 is fixed to inside of the floating load-bearing block mounting base 2, and the disc spring guide post 4 is of an inverted T-shaped structure. The floating load-bearing block 1 is provided with an inverted T-shaped groove that is fit with the inverted T-shaped structure, the disc spring 3 is disposed between the inverted T-shaped structure and inverted T-shaped groove. There are two groups of the disc spring guide posts 4 and the disc springs 3, which are uniformly distributed on both sides of the spring supporting plate 5, to ensure that the floating load-bearing block 1 is uniformly stressed when the floating load-bearing block 1 is in contact with the steel plate. When there is no load on the disc spring 3, a load-bearing block floating gap is formed between the lower surface of the floating load-bearing block 1 and upper surface of the floating load-bearing block mounting base 2 through the spring force of the disc spring 3;

The load limiting switch 9 is mounted on the side of the limiting switch tip 8, and in a non-working state, the load limiting switch 9 and the limiting switch tip 8 are in a state of separation. The end of the load limiting switch 9 is of a roller type, when the limiting switch tip 8 is pressed down, the roller type structure can enhance the sensitivity of contact between the limiting switch tip 8 and the load limiting switch 9.

Taking four steel plates welded on vehicle side beam as an example, the working process of the supporting head is described as follows:

Where there is no load, the disc spring 3 in a free stretching state, a load-bearing block floating gap is formed between the floating load-bearing block 1 and the floating load-bearing block mounting base 2 through the spring action of the disc spring 3, and the size of the floating gap between both is defined by the stop block 7; at this time, the limiting switch tip 8 and load limiting switch 9 are in a state of separation.

When operating under loading, the vehicle body lifting column 10 rises to contact with four steel plates of the vehicle side beam; the floating load-bearing block 1 mounted on the upper end of the vehicle body lifting column 10 is pressed down with the force. Since the floating load-bearing block 1 is in a spherical fit with the floating load-bearing block mounting base 2, the floating load-bearing block 1 can swing at any direction on the above of the floating load-bearing block mounting base 2 according to the state of the steel plate in contact, and complete the automatic alignment, and the upper surface of the floating load-bearing block is in full contact and coincides with the multiple steel plates. The floating load-bearing block 1 moves downwards, to sequentially drive the stop block 7, spring supporting plate 5 and limiting switch tip 8 to move downwards until the limiting switch tip 8 triggers the load limiting switch 9, and the lifting system automatically shuts down, to prevent excessive rise of the vehicle body lifting column 10 that may cause damage to the vehicle.

Example 2

The structure and composition of the self-adjusting supporting head in example 2 are basically the same as those in example 1, with the distinguishing characteristics as follows: the stop block 7 is of an inverted T-shaped structure, and the top end of the inverted T structure is fixedly connected with the floating load-bearing block 1, and the bottom of the inverted T-shaped structure is of a planar structure. The planar structure of the bottom end of the inverted T-shaped structure is in a point contact with the spherical structure at the top of the spherical top end, to make concentrated load-bearing force exerted on the T-shaped structure by the stop block 7, facilitating to press the spring 6 by the spring supporting plate 5 and making the limiting switch tip 8 to move downwards.

Technicians skilled in the art should understand that the drawings are only for a preferred embodiment, and the structures and compositions in the drawings are not necessary for the implementation of this invention.

Technicians skilled in the art should understand that the disc spring guide posts and disc springs are not limited to two groups. In order to enhance the reliability of the load-bearing block floating gap between the floating load-bearing block 1 and the floating load-bearing block mounting base 2, multiple groups of disc spring guide posts and disc springs can be provided according to the specific loads.

Technicians skilled in the art should understand that the floating connector is not limited to the combination of disc spring guide post and disc spring, and any elastic component that connects the floating load-bearing block and floating load-bearing block mounting base can be used.

Technicians skilled in the art should understand that the supporting head is not only applicable to the lifting operation of four steel plates welded on vehicle side beam, but also applicable to multiple steel plates welded on vehicle side beams.

Finally it should be noted that, the above embodiments are illustrative for the invention rather than limited to the invention. Although this invention is described in details with reference the aforesaid embodiments, those skilled in the art should understand that they can amend the technical solutions described in the aforesaid embodiments, or give equivalent replacements of some technical features, and those amendments or replacements will not depart from the scope of protection in the invention.

The invention claimed is:

1. A self-adjusting supporting head, comprising a vehicle body lifting column (10) and a load-bearing detection device arranged on the vehicle body lifting column (10), the load-bearing detection device comprises a spring supporting plate (5), a spring (6), a limiting switch tip (8), a load limiting switch (9) and a floating load-bearing adjusting device, the floating load-bearing adjusting device is mounted at the top of the vehicle body lifting column (10) and the spring supporting plate (5) is arranged below the floating load-bearing adjusting device, the spring (6) is mounted on the periphery of the spring supporting plate (5), the upper end of the limiting switch tip(8) is connected to the spring supporting plate (5) and on the low end side is provided with a load limiting switch (9), wherein the floating load-bearing adjusting device comprises a floating load-bearing block (1), a floating load-bearing mounting base (2) and a floating connector, the floating load-bearing block (1) is mounted at the upper end of the vehicle body lifting column (10), the floating load-bearing block mounting base (2) is mounted below the floating load-bearing block (1), the floating load-bearing block (1) is connected with the floating load-bearing block mounting base (2) by a floating connector, and the floating load-bearing block(1) is in spherical fit with the floating load-bearing block mounting base(2), a floating gap is formed by the floating connector between the floating load-bearing block (1) and the floating load-bearing block mounting base (2).

2. The self-adjusting supporting head according to claim 1, wherein the upper portion of the floating load-bearing block mounting base (2) is provided with a cylindrical hole, and the cylindrical hole is of a two-stage step-type structure from top to bottom, including a first step and a second step, the first step is used to restrict the downward movement of the spring supporting plate (5), and the second step is used to restrict the downward movement of the spring (6).

3. The self-adjusting supporting head according to claim 2, wherein the floating load-bearing adjusting device is further provided with a stop block (7), the stop block (7) is fixed on the floating load-bearing block (1), the bottom part of the stop block (7) is probed into the interior of the cylindrical hole, and a stop block movement gap is provided between the bottom part of the stop block (7) and the cylindrical hole.

4. The self-adjusting supporting head according to claim 3, wherein the spring supporting plate (5) is of a T-shaped structure, including a spherical top end and a cylindrical supporting plate, the upper portion of the spherical top end is in point contact with the bottom end of the stop block (7), the lower end of the supporting plate is connected with the limiting switch tip (8), and the spring (6) is arranged at the periphery of the cylindrical supporting plate.

5. The self-adjusting supporting head according to claim 4, wherein the stop block (7) is of an inverted T-shaped structure, and the top end of the inverted T-shaped structure is connected with the floating load-bearing block (1) fixedly, the bottom end of the inverted T-shaped structure is in a point contact with the upper portion of the spherical top end.

6. The self-adjusting supporting head according to claim 1, wherein the floating connector comprises a disc spring (3) and a disc spring guide post (4), the disc spring guide post (4) is fixed to inside of the floating load-bearing block mounting base (2), and the disc spring guide post (4) is of an inverted T-shaped structure, the floating load-bearing block (1) is provided with an inverted T-shaped groove that is fit with the inverted T-shaped structure, the disc spring (3) is disposed between the inverted T-shaped structure and inverted T-shaped groove, when there is no load of the disc spring (3), a load-bearing block floating gap is formed between the lower surface of the floating load-bearing block (1) and upper surface of the floating load-bearing block mounting base (2).

7. The self-adjusting supporting head according to claim 6, wherein there are two groups of the disc spring guide posts (4) and the disc springs (3), which are uniformly distributed on both sides of the spring supporting plate (5).

8. The self-adjusting supporting head according to claim 1, wherein the end of the load limiting switch (9) is of roller type.

9. The self-adjusting supporting head according to claim 5, wherein the floating connector comprises a disc spring (3) and a disc spring guide post (4), the disc spring guide post (4) is fixed to inside of the floating load-bearing block mounting base (2), and the disc spring guide post (4) is of an inverted T-shaped structure, the floating load-bearing block (1) is provided with an inverted T-shaped groove that is fit with the inverted T-shaped structure, the disc spring (3) is disposed between the inverted T-shaped structure and inverted T-shaped groove, when there is no load of the disc spring (3), a load-bearing block floating gap is formed between the lower surface of the floating load-bearing block (1) and upper surface of the floating load-bearing block mounting base (2).

10. The self-adjusting supporting head according to claim 9, wherein there are two groups of the disc spring guide posts (4) and the disc springs (3), which are uniformly distributed on both sides of the spring supporting plate (5).

* * * * *